US005835991A

United States Patent [19]

Niiyama et al.

[11] Patent Number: 5,835,991

[45] **Date of Patent: *Nov. 10, 1998**

[54] GETTER, GETTER DEVICE AND FLUORESCENT DISPLAY DEVICE

[75] Inventors: Takahiro Niiyama; Shigeo Itoh; Teruo Watanabe, all of Mobara, Japan

[73] Assignee: Futaba Denshi Kogyo Kabushiki Kaisha, Mobara, Japan

[ * ] Notice: The term of this patent shall not extend beyond the expiration date of Pat. No. 5,656,889.

[21] Appl. No.: 730,174

[22] Filed: Oct. 15, 1996

Related U.S. Application Data

[63] Continuation of Ser. No. 272,001, Jul. 8, 1994, Pat. No. 5,656,889.

[30] Foreign Application Priority Data

Jul. 8, 1993 [JP] Japan ..... 5-169176
Jul. 8, 1993 [JP] Japan ..... 5-169177

[51] Int. Cl.[6] ..... H01J 1/02

[52] U.S. Cl. ..... 313/553; 313/422; 313/495

[58] Field of Search ..... 313/495, 422, 313/553

[56] References Cited

U.S. PATENT DOCUMENTS 4,972,116 11/1990 Tatsuda et al. ..... 313/422
5,223,766 6/1993 Nakayama et al. ..... 313/495

*Primary Examiner*—Sandra L. O'Shea
*Assistant Examiner*—Vip Patel
*Attorney, Agent, or Firm*—Oblon, Spivak, McClelland, Maier & Neustadt, P.C.

[57] ABSTRACT

A getter device capable of being re-activated as required and arranged in a narrow space in an envelope. The getter is arranged in a layer-like manner in an envelope of an electronic element to provide, in the envelope, a film-like getter for keeping an interior of the envelope at a vacuum. Electrons emitted from an electron feed section are impinged on the getter to activate it. The getter activated adsorbs thereon gas in an envelope of an image display device.

7 Claims, 5 Drawing Sheets

GETTER, GETTER DEVICE AND FLUORESCENT DISPLAY DEVICE

This is a continuation of application Ser. No. 08/272,001 filed on Jul. 8, 1994 now U.S. Pat. No. 5,656,889.

BACKGROUND OF THE INVENTION

This invention relates to a getter device, and more particularly to a getter device arranged in an envelope of an electronic element to keep the envelope at a vacuum and a fluorescent display device including a getter device arranged in an envelope.

A conventional image display device including a field emission cathode is constructed, for example, in such a manner as shown in FIG. 9. More particularly, the conventional image display device generally designated at reference numeral 200 in FIG. 9 includes an envelope 201 formed by sealedly joining a cathode substrate 202 and an anode substrate 203 to each other through spacers 204. The cathode substrate 202 is provided on an inner surface thereof with a field emission cathode and correspondingly anode substrate 203 is provided on an inner surface with a phosphor-deposited anode electrode acting as a display section in a manner to be opposite to the field emission cathode. In the image display device generally constructed as described above, the spacers 204 each are typically formed into a thickness as small as 500 $\mu$m so that the field emission cathode and the anode electrode may be arranged while minimizing a distance therebetween. However, a conventional getter device 205 constituted by an annular getter vessel made of a metal material and having a getter material contained therein is generally formed into a thickness as large as several mm, so that the conventional image display device fails to arrange the getter device 205 in the envelope 201. In view of the fact, the conventional image display device, as shown in FIG. 9, employs a structure wherein a getter chamber member 206 of a box-like shape is arranged on a rear surface of the cathode substrate 202 of the envelope 201 and communicates through an evacuation hole 207 of a small size with the envelope 201. Then, the getter material is heated using suitable heating means externally arranged such as high-frequency heating or the like, resulting in being evaporated and then deposited on an inner surface of the getter chamber member 206 to form a getter mirror thereon.

As will be noted from the foregoing, the conventional getter device is disadvantageously increased in thickness, resulting in failing to be arranged in a narrow space. Thus, the conventional getter device causes the image display device which is an example of an electronic device having such a getter device incorporated therein to meet with disadvantages.

One of the disadvantages is that the image display device having a field emission cathode incorporated therein is featured in that the envelope is formed into a high thin configuration. However, mounting of the getter device on the envelope, as described above, causes the whole image display device to be substantially increased in thickness, to thereby deteriorate the above-described feature of the image display device.

Another disadvantage is that arrangement of the getter device 205 in the getter chamber member 206 additionally requires a step of providing the getter chamber member 206, leading to an increase in manufacturing cost.

The image display device, as described above, is so constructed that the getter device 205 is arranged in the getter chamber member 206 mounted on the envelope 201 and a getter film 208 and envelope 201 are permitted to communicate through the evacuation hole of a small size with each other. Unfortunately, in order to permit gas produced in the envelope 201 to be adsorbed on a getter film 208, such a construction causes the gas to be required to enter the getter chamber member 206 through the evacuation hole 207 of a small hole, leading to a decrease in efficiency of the getter device as compared with a construction wherein the getter film is formed directly on an inner surface of the envelope.

A further disadvantage countered with the conventional image display device is that a conventional deposition-type getter film formed in the getter device, when it loses activity once, is hard to be activated again, resulting in being gradually decreased in gas adsorbing capability with lapse of operation of the electronic device, resulting in a degree of vacuum of the device being deteriorated.

Still another problem is due to the construction of the conventional getter device that the getter material is charged in the getter vessel made of a metal material. The construction causes heating efficiency of the getter to be deteriorated.

SUMMARY OF THE INVENTION

The present invention has been made in view of the foregoing disadvantages of the prior art.

Accordingly, it is an object of the present invention to provide a getter device which is capable of being re-activated as required and arranged in a narrow inner space of an envelope.

It is another object of the present invention to provide a fluorescent display device having a getter device incorporated therein which is capable of being re-activated as required and arranged in a narrow inner space of an envelope of the fluorescent display device.

Thus, the getter device of the present invention, when it is incorporated in an electronic device such as an image display device using a field emission cathode as an electron source, effectively prevents the feature of the electronic device that the envelope is decreased in thickness from being deteriorated.

It is a further object of the present invention to provide a getter which is capable of being decreased in thickness to a degree sufficient to permit it to be arranged in a narrow inner space of an envelope and heating during formation of a getter film to be carried out with increased efficiency.

It is still another object of the present invention to provide a fluorescent display device including a getter which is decreased in thickness to a degree sufficient to permit it to be arranged in a narrow inner space of an envelope and heating during formation of a getter film to be carried out with increased efficiency.

Thus, the getter of the present invention, when it is incorporated in an electronic device such as an image display device using a field emission cathode as an electron source, effectively prevents the feature of the electronic device that the envelope 18 decreased in thickness from being deteriorated.

In accordance with one aspect of the present invention, a layer-like getter is provided. The getter is arranged in an envelope of an electronic element to provide, in the envelope, a film-like getter for keeping an interior of the envelope at a vacuum.

In accordance with another aspect of the present invention, a getter device arranged in an envelope of an electronic element to keep an interior of the envelope at a vacuum is provided. The getter device includes a getter material and an electron feed section for permitting electrons to be impinged on the getter material to activate the getter material.

In a preferred embodiment of the present invention, the electron feed section comprises a field emission cathode.

In a preferred embodiment of the present invention, the getter material is in the form of a film-like shape.

In accordance with a further aspect of the present invention, a fluorescent display device is provided. The fluorescent display device includes an envelope and a getter device arranged in the envelope. The getter device includes a getter material and an electron feed section for permitting electrons to be impinged on the getter material to activate the getter material.

In a preferred embodiment of the present invention, the getter material is in the form of a film-like shape.

In the present invention constructed as described above, electrons emitted from the electron feed section are impinged on the getter material to activate it. The getter material activated adsorbs thereon gas in the envelope. The activation may be repeated as required.

Also, in accordance with the present invention, a getter is provided which is arranged in an envelope of an electronic element to keep an interior of the envelope at a vacuum. The getter includes a getter film prepared by forming a getter material into a getter layer in the envelope by film formation techniques and forming the getter layer into the getter film by evaporation due to heating.

In a preferred embodiment of the present invention, the getter layer is supported on a support layer arranged so as to be contacted with a part of a lower surface of the getter layer.

In a preferred embodiment of the present invention, the getter layer is formed on a support layer arranged in the envelope. The getter layer and support layer each are formed with openings which permit the getter layer to be supported at a part of an lower surface thereof on the support layer and the getter film is formed in the openings of the support layer.

Furthermore, in accordance with the present invention, a fluorescent display device is provided. The fluorescent display device includes an envelope, a display section arranged in the envelope, a field emission cathode acting as an electron source for the display section, and a getter arranged in the envelope to keep an interior of the envelope at a vacuum. The getter includes a getter film prepared by forming a getter material into a getter layer in the envelope by film formation techniques and forming the getter layer into the getter film by evaporation due to heating and a support layer arranged so as to support the getter layer thereon in a manner to be contacted with a part of a lower surface of the getter layer. The support layer is formed together with an insulating layer of the field emission cathode.

In the present invention constructed as described above, the getter layer is fed with energy from an outside of the envelope, resulting in being evaporated to form the getter film in the envelope. The getter film thus formed effectively adsorbs thereon gas in the envelope.

BRIEF DESCRIPTION OF THE DRAWING

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, the present invention will be detailedly described hereinafter with reference to the accompanying drawings.

Referring first to FIGS. 1 to 4, a first embodiment of an image display device according to the present invention which is in the form of a fluorescent display device is illustrated. A image display device (hereinafter also referred to as "display device") of the illustrated embodiment includes a field emission cathode of the horizontal type acting as an electron source for a getter device and exhibiting a gettering action of permitting electrons emitted from the electron source to be impinged on a getter material to activate it and a field emission cathode of the vertical type acting as an electron source for a display section.

Figure 1:
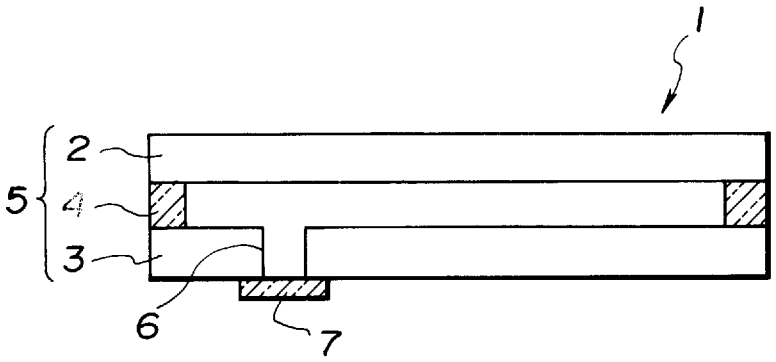
FIG. 1 is a sectional view showing a first embodiment of an image display device according to the present invention.

The display device 1, as shown in FIG. 1, includes a box-like envelope 5, which is formed by sealedly joining an anode substrate 2 made of an insulating and light-permeable material and a cathode substrate 3 made of an insulating material to each other through insulating spacers 4. Both substrates 2 and 3 are arranged oppositely to each other with a gap of 500 $\mu$m or less being defined therebetween. In the illustrated embodiment, the gap may be set to be 200 $\mu$m or less. The cathode substrate 3 is formed at a corner thereof with an evacuation hole 6, through which gas in the envelope 5 is evacuated. After the evacuation, the evacuation hole 6 is sealedly closed by a lid 7, resulting in the envelope 5 being kept at a high vacuum.

Figure 2:
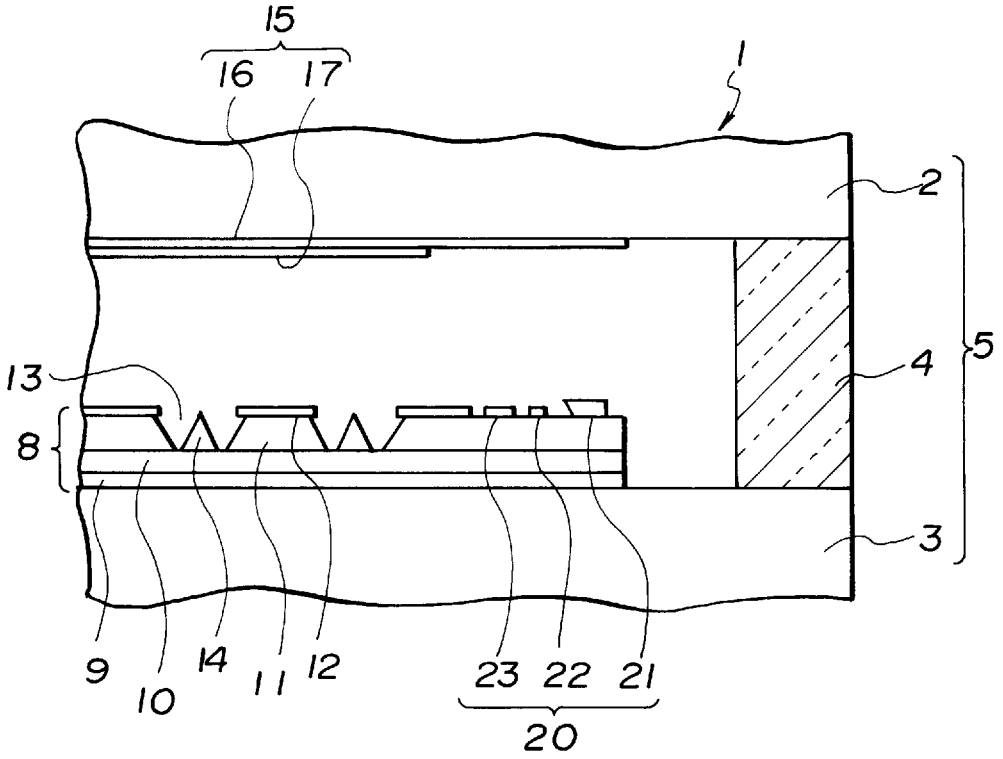
FIG. 2 is a fragmentary enlarged sectional view showing an essential part of the image display device shown in FIG. 1.
Figure 3:
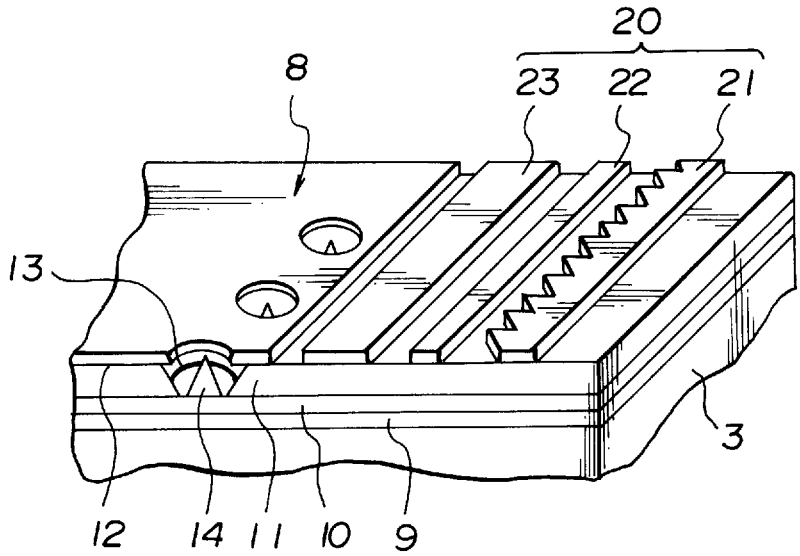
FIG. 3 is a fragmentary enlarged perspective view showing an essential part of the image display device shown in FIG. 1.

The cathode substrate 3, as shown in FIGS. 2 and 3, is formed on a portion of an inner surface thereof positioned in the envelope 5 with a field emission element or cathode 8 of the vertical type acting as an electron source for a display section. The field emission cathode 8 includes a cathode electrode 9 formed on the inner surface of the cathode substrate 3, a resistive layer 10 formed on the cathode electrode 9, an insulating layer 11 formed of silicon oxide or the like on the resistive layer 10, a gate electrode 12 and emitters 14 of a cone-like shape provided on the resistive layer 10 and positioned in holes 13 formed through each of the insulating layer 11 and gate electrode 12.

The anode substrate 2 is formed on a portion of an inner surface thereof positioned in the envelope 5 with anode electrode 15 so as to be opposite to the field emission cathode 8 described above. The anode electrode 15 includes a light-permeable anode conductor 16 provided on the inner surface of the anode substrate 2 and a phosphor layer 17 arranged on the anode conductor 16. Thus, when electrons emitted from the field emission cathodes 8 are impinged on the phosphor layer 17 to excite it, resulting in the phosphor layer 17 emitting light, it is observed through the anode conductor 16 and anode substrate 2 which are light-permeable.

As shown in FIGS. 2 and 3, the cathode substrate 3 is formed on a part of a corner thereof on which the field emission cathode 8 is not formed with a getter device 20 which is basically constructed in substantially the same manner as a field emission cathode of the flat type.

The getter device 20 is formed on the insulating layer 11 arranged on the cathode substrate 3. More particularly, it includes an emitter 21 formed with a plurality of projections of a saw-tooth like shape, a strip-like gate 22 arranged so as to be spaced by a predetermined distance from the emitter 21 and a getter material 23 arranged oppositely to the emitter 21 with the strip-like gate 22 being interposed therebetween. The emitter 21 is made of a high-melting metal material or a compound material of a low work function. The gate 22 may be made of a high-melting metal material. The getter material 23 serving as an anode may be made of a metal material such as Ba, Ni, W, Ti, V, Zr, Al, Ag, Au, Mg, Ca, Mn, Ce, Nb, Mo, Ta, Th or the like or a compound of the metal material. Also, alloy such as Zr—Ni, Zr—Al, Ag—Ti or the like may be used for the getter material 23. The getter device may be arranged at a position other than the above-described position in the envelope. For example, the illustrated embodiment may be constructed in such a manner that the envelope 5 is provided on an inner surface thereof with the anode electrode and then the getter material is formed into a thin film on the anode electrode by deposition.

Thus, in the display device of the illustrated embodiment, the field emission cathode 8 is used as the electron source for the display section, so that the getter device 20 may be effectively received in a narrow inner space of the envelope 5 of a thin configuration defined between the anode substrate 2 and the cathode substrate 3 which are arranged oppositely to each other at a reduced interval.

In the display device of the illustrated embodiment constructed as described above, a voltage of tens to several kV is applied to the getter material 23 acting as the anode for capturing electrons to apply an electric field to the emitter 21, to thereby cause the emitter 21 to emit electrons from the projections thereof. Then, the electrons emitted are caused to impinge on the getter material 23 to activate it. The getter material 23 thus activated, resulting in reactivity thereof with another atom being enhanced carries out a gettering function of adsorbing thereon gas molecules in the envelope 5 of the display device 1.

Activation of the getter material 23 by impingement of electrons thereon may be continuously carried out during driving of the display device 1. Alternatively, the activation may be intermittently carried out at suitable time intervals.

Also, a plurality of such getter devices 20 as described above each including the getter material 23 and the emitter 21 acting as the electron feed section may be arranged. Such arrangement permits the getter materials 23 to be activated in a suitable order, resulting in any of the getter materials 23 being constantly activated during driving of the display device 1. This, even when gas is temporarily emitted from the getter 23 when any of the getter device is activated, permits the gas to be absorbed on any remaining getter activated, to thereby minimize a disadvantage due to the gas.

The emitter 21, the gate 22 and the getter material 23 acting as the anode for capturing electrons which constitute the getter device 20 may be formed by photolithography. The formation may be carried out in association with or separate from manufacturing of the field emission cathode 8.

Also, the getter material 23 may be formed into a thin film by photolithography as described above. Alternatively, it may be formed into a thick film or a bulky configuration by printing or the like.

Figure 4:
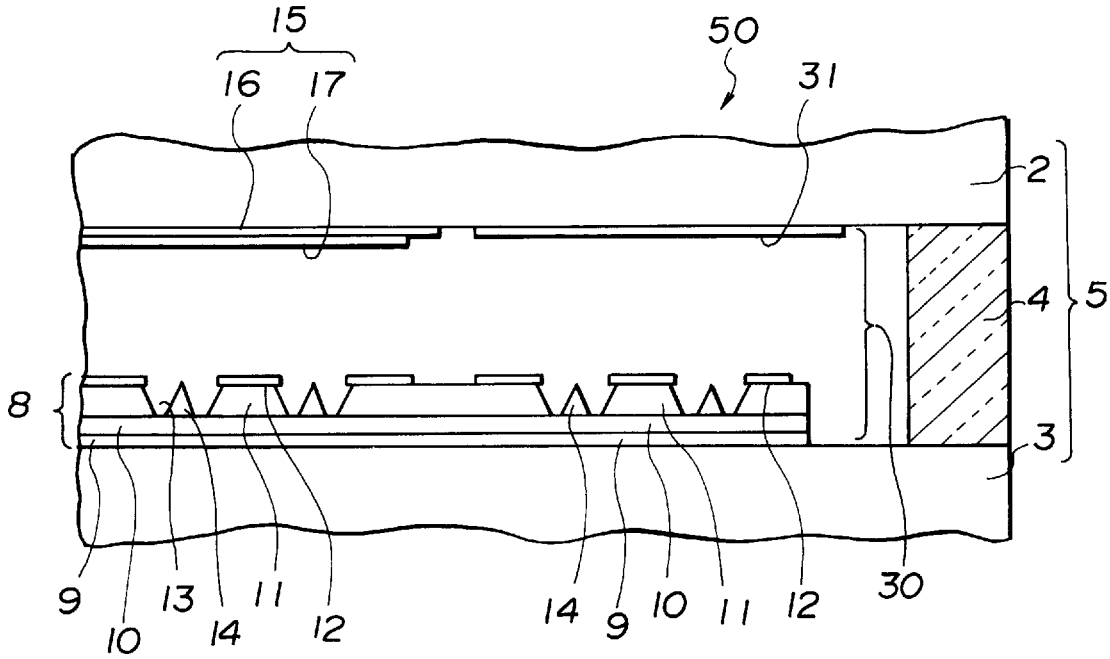
FIG. 4 is a fragmentary enlarged sectional view showing an essential part of a second embodiment of an image display device according to the present invention.

Referring now to FIG. 4, a second embodiment of an image display device according to the present invention is illustrated.

An image display device of the second embodiment which is generally designated at reference numeral 50 is in the form of a fluorescent display device including a getter 30 constructed on the basis of a principle of a field emission cathode of the vertical type and a field emission cathode 8 of the vertical type acting as an electron source for a display section as in the first embodiment.

The display device 50 likewise includes an envelope 5, an field emission cathode 8, an anode 15 and the like, which are constructed in substantially the same manner as those in the first embodiment. Thus, the components are designated at like reference numerals.

In the display device 50 of the second embodiment, a cathode substrate 3 is formed on a corner thereof with a field emission cathode 8 constructed in substantially the same manner as in the first embodiment and acting as an electron feed section. Components of the field emission cathode 8 which are constructed in substantially the same manner as those in the first embodiment are designated at like reference numerals.

An anode substrate 2 is formed on an inner surface thereof with a getter material 31 in the form of a film-like configuration and in a manner to be opposite to the electron feed section. The getter material 31 acts as an anode for capturing electrons and may be made of the same material as the getter material 23 in the first embodiment described above.

In the second embodiment constructed as described above, when electrons field-emitted from the electron feed section are caused to be impinged on the getter material 31 of the anode substrate 2 arranged oppositely to the electron feed section, the getter material 31 is activated, resulting in carrying out a gettering action. When the getter material 31 is decreased in getting capability, activation of the material 31 may be attained by impinging electrons thereon again.

In each of the embodiments described above, the display device is in the form of a fluorescent display device. However, the getter of the present invention may be effectively applied to any other display element so long as it includes an envelope constructed in an airtight manner. Also, the display devices 1 and 50 of the first and second embodiments each include the field emission cathode 8 acting as the electron source for the display section. Alternatively, the electron source may comprise a filamentary cathode or the like. Even in this instance, the feature of the getter of the present invention that it is decreased in thickness is not deteriorated, resulting in the envelope being kept decreased in thickness as compared with the prior art.

Also, in each of the embodiments described above, the field emission cathode is used as an electron feed source for feeding electrons which are impinged on the getter material to activate it. Alternatively, the electron feed source may be constructed on the basis of any other suitable principle. For example, a filamentary cathode made of an electron emission material or the like may be used as the electron feed section.

The getter device of each of the embodiments described above includes the getter material of the non-evaporation type and the electron feed section, resulting in being readily arranged in a narrow inner space of the envelope. Also, the getter device permits the getter material to be arranged at a position in the envelope at which gas tends to be produced, resulting in the getter satisfactorily exhibiting a gettering function. Further, the getter device permits the getter material to be repeatedly activated as desired, to thereby exhibit an increased gettering function for a long period of time, resulting in semipermanently keeping the envelope at a high vacuum.

Further, the fluorescent display device provided with the getter device permits the envelope to be formed into a minimized thickness. In particular, when it includes the field emission cathode acting as the electron source for the display section, a getter chamber member required in the prior art can be eliminated, leading to simplification in manufacturing of the fluorescent display device. Also, use of the field emission cathode as the electron source for the display section in the fluorescent display device effectively prevents the features of the fluorescent display device that the envelope is kept decreased in thickness from being deteriorated. Further, the getter material can be repeatedly activated, so that the envelope may be kept at a high vacuum.

Figure 5:
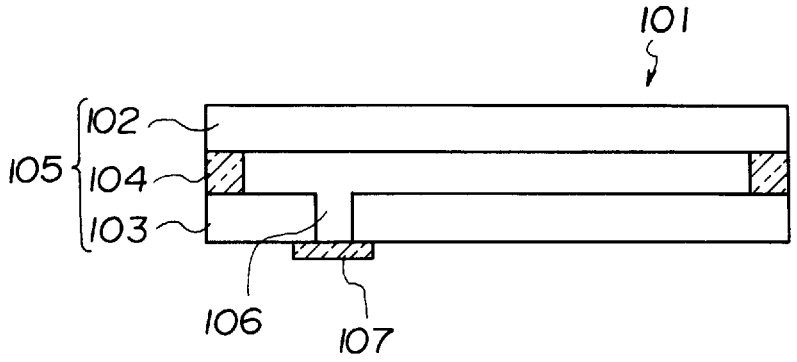
FIG. 5 is a sectional view showing an third embodiment of an image display device according to the present invention.
Figure 6:
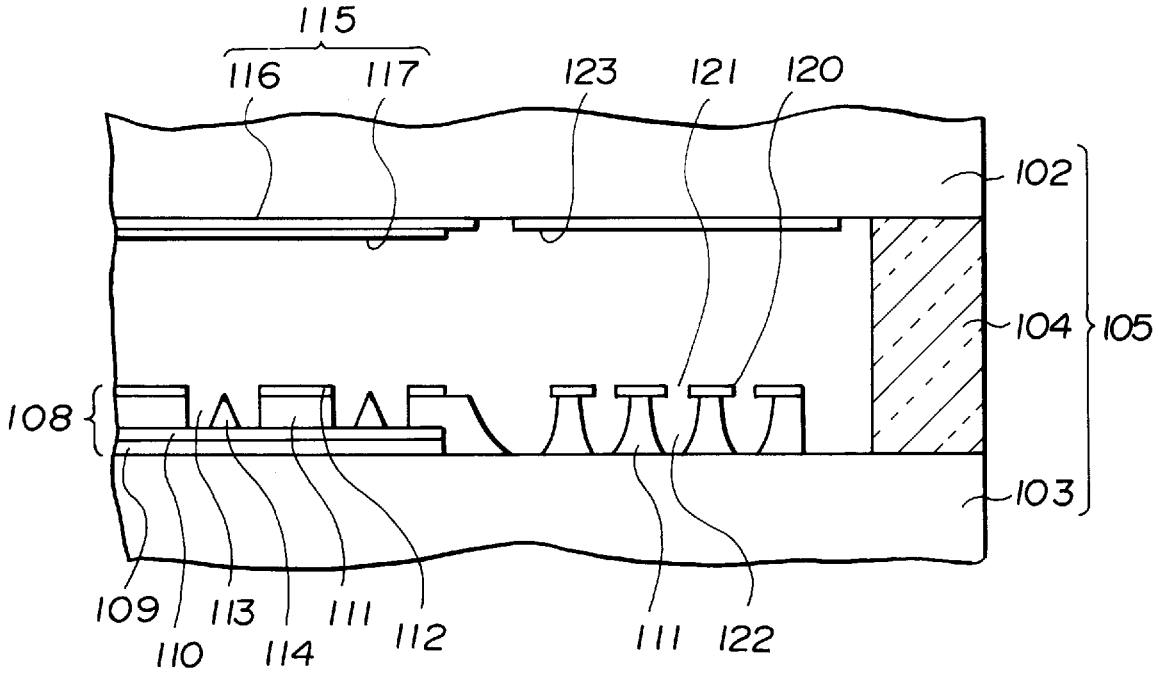
FIG. 6 is a fragmentary enlarged sectional view showing an essential part of the image display device shown in FIG. 5.
Figure 7:
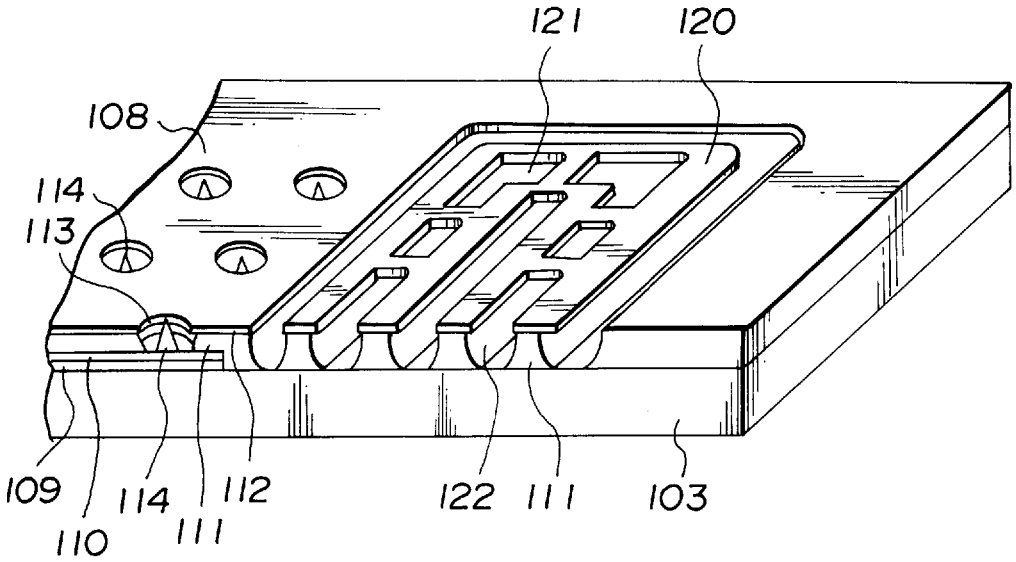
FIG. 7 is a fragmentary enlarged perspective view showing an essential part of the image display device shown in FIG. 5.

Referring now to FIGS. 5 to 7, a third embodiment of an image display device according to the present invention is illustrated. A display device of the illustrated embodiment generally designated at reference numeral 101 is in the form of a fluorescent display device including a field emission cathode of the vertical type acting as an electron source for a display section.

The display device 101 includes an envelope 105 of a thin box-like shape formed by sealedly joining an insulating and light-permeable anode substrate 102 and an insulating cathode substrate 103 to each other through insulating spacer members 104. Both substrates 102 and 103 are arranged so as to be spaced at an interval of 500 $\mu$m or less from each other. In the illustrated embodiment, the interval is set to be 200 $\mu$m. The cathode substrate 103 is formed at a corner thereof with an evacuation bole 106, through which the envelope 105 is evacuated. After the evacuation, the evacuation hole 106 is sealedly closed by a lid member 107, so that the envelope 105 may be kept at a high vacuum.

The cathode substrate 103, as shown in FIGS. 6 and 7, is formed on a portion of an inner surface thereof positioned in the envelope 105 with a field emission cathode 108 of the vertical type acting as an electron source for a display section. The field emission cathode 108 includes a cathode electrode 109 formed on the inner surface of the cathode substrate 103, a resistive layer 110 formed on the cathode electrode 109, an insulating layer 111 formed of silicon oxide or the like on the resistive layer 110, a gate electrode 112 formed on an insulating layer 111, and emitters 114 of a conical shape formed on the resistive layer 110 and positioned in holes 113 formed through each of the insulating layer 111 and gate electrode 112.

The anode substrate 102 is formed on a portion of an inner surface thereof positioned in the envelope 105 with an anode electrode 115 in a manner to be opposite to the field emission cathode 108. The anode electrode 115 includes a light-permeable anode conductor 116 provided on the anode substrate 102 and a phosphor layer 117 formed on the anode conductor 116. Thus, when electrons emitted from the field emission cathode 108 are impinged on the phosphor layer 117 of the anode electrode 115 to excite it, resulting in the phosphor layer 117 emitting light, the light is observed through the light-permeable anode conductor 116 and light-permeable anode substrate 102.

The cathode substrate 103, as shown in FIGS. 6 and 7, is formed on a part of a corner thereof free of the field emission cathode 108 with a getter layer 120. The getter layer 120 is supported on the insulating layer 111 formed on the cathode substrate 103 and provided with openings 121, resulting in being formed into any desired pattern.

The getter layer 120 may be formed of a thin or thick film into a thickness of, for example, several $\mu$m to hundreds $\mu$m. The getter layer 120 may be formed by any suitable techniques such as, for example, photolithography, printing, vapor deposition, sputtering, PVD techniques, CVD techniques or the like. Formation of the getter layer 120 by photolithography may be carried out in the same step as the gate electrode 1 2 of the field emission cathode 108.

The insulating layer 111 acting also as the support layer, as described above, is formed with openings 122 corresponding to the openings 121 of the getter layer 120. The openings 122 of the insulating layer 111 each are formed into a configuration upwardly enlarged, so that the getter layer 120 is supported at a part of a lower surface thereof on the insulating layer 111. The openings 122 thus arranged at the insulating layer 111 may be formed by subjecting a side surface of each of the openings 122 to isotropic etching using an etching liquid.

The getter layer 120 includes a getter material. The getter material may be made of a metal material such as Ba, Ni, W, Ti, V, Zr, Al, Ag, Au, Mg, Ca, Mn, Ce, Nb, Mo, Ta, Th or the like or a compound of the metal material. Also, alloy such as Zr—Ni, Zr—Al, Ag—Ti or the like may be used for the getter material. Alternatively, any combination of two or more selected from the above-described materials may be conveniently used as the getter material.

In the envelope 105 of the display device 101 constructed as described above, the getter layer 120 is applied thereto energy. For example, electric power is fed trough an external lead terminal (not shown) to the getter layer 120 to heat it. Also, the getter layer 120 is heated by high-frequency induction-heating externally carried out.

The getter layer 120 is contacted at only a part of the lower surface thereof with the insulating layer 111. Such construction effectively restrains the insulating layer from taking heat from the getter layer 120 during the heating, to thereby evaporate the getter material with high efficiency. The getter material evaporated forms a getter film 123 exhibiting a gettering function on the inner surface of the anode substrate 102 opposite to the getter layer 120.

As described above, in the fluorescent display device of the illustrated embodiment, the field emission cathode 108 is arranged so as to act as the electron source for the display section, so that the getter may be satisfactorily received in a narrow inner space of the envelope 105 in which the anode substrate 102 and cathode substrate 103 are spaced from each other at a reduced interval.

The getter film 123 formed as described above effectively adsorbs thereon gas molecules in the envelope 105, to thereby keep the envelope at a high vacuum. More particularly, this permits gettering to be carried out in the envelope 105 of the display device 101. After formation of the getter film 123, the getter material which has not been evaporated remains on the getter layer 120. The remaining getter material is kept activated by the above-described heating, resulting in likewise exhibiting a gettering function.

Figure 8:
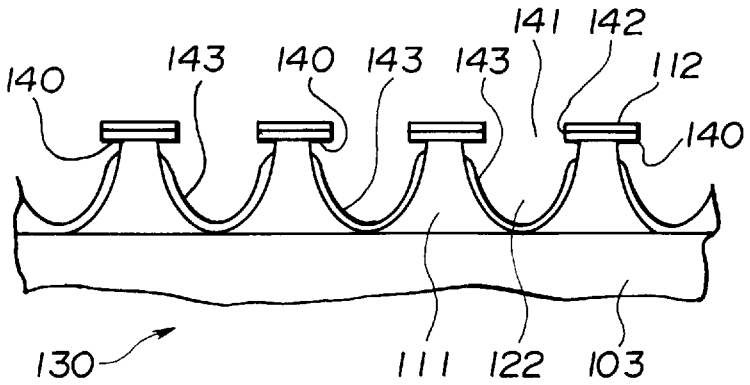
FIG. 8 is a fragmentary enlarged sectional view showing an essential part of a fourth embodiment of an image display device according to the present invention.
Figure 9:
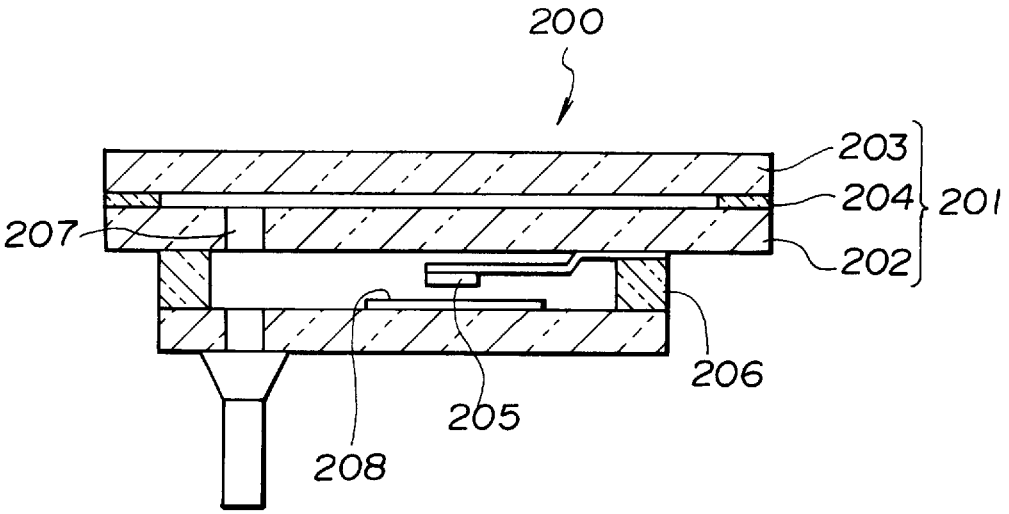
FIG.9 (PRIOR ART)
FIG. 9 is a sectional view showing a fluorescent display device including a conventional getter.

Referring Snow to FIG. 8, a fourth embodiment of an image display device according to the present invention is illustrated.

An image display device of the fourth embodiment which is generally designated at reference numeral 130 is in the form of a fluorescent display device including a field emission cathode 108 of the vertical type acting as an electron source for a display section as in the third embodiment.

The display device 130 likewise includes an envelope 105, a field emission cathode 108, an anode 115 and the like, which are constructed in substantially the same manner as those in the first embodiment. Thus, the components are designated with like reference numerals.

A cathode substrate 103 is formed at a corner thereof with a getter layer 140 in a predetermined pattern having openings 141 formed therethrough. The getter layer 140 is formed on an insulating layer 111 of the field emission cathode 108 acting also as a support layer. The getter layer 140 is formed thereon with a gate electrode 112 of the same pattern. Formation of such construction may be carried out in the same step as manufacturing of the field emission cathode 108.

More particularly, in a step of manufacturing the gate electrode of the field emission cathode 108, a first layer for the gate electrode is formed of a getter material on an upper surface of the insulating layer 111, to thereby provide the getter layer 140. Then, a second layer for the gate electrode is formed of the gate material in the same pattern on the getter layer 140, to thereby provide the gate electrode 112.

Then, the insulating layer Ill is subject to etching through the opening 141 of the getter layer 140 and the opening 142 of the gate electrode 112. A portion of each opening 122 of the insulating layer 111 at which the getter layer 140 is positioned is covered with a resist, aluminum or the like, to thereby prevent the emitters from being formed on the portion in the next step.

In the fluorescent display device of the fourth embodiment described above, the gate electrode 112 is directly fed with electric power to heat the getter layer 140 under the gate electrode 112. Alternatively, the getter layer 140 may be heated by high-frequency heating. This causes the getter layer 140 to be evaporated, followed by deposition on a surface of each of the openings 122 of the insulating layer 111, to thereby provide the getter film 143.

The illustrated embodiment permits the openings 122 of the insulating layer 111 to have an increased surface area, so that the getter film 143 formed in each of the openings may have a significantly increased area, to thereby exhibit an enhanced gettering function.

Also, during deposition of the getter material, a part of the getter material adheres through the openings of the gate electrode 112 to the inner surface of the anode substrate 102 opposite thereto. However, the openings 142 of the gate electrode 112 restrain an angle at which the getter material spreads toward the anode substrate 102 from being increased, to thereby prevent the gate film formed on the anode substrate 102 from excessively spreading.

In each of the third and fourth embodiments described above, the display device is in the form of a fluorescent display device. However, the getter of the present invention is effectively applicable to any other electron element so long as it includes an airtight envelope. Also, the display device of each of the third and fourth embodiments includes the field emission cathode 108 acting as the electron source for the display section. However, the field emission cathode may be replaced with a filamentary cathode including an electron emission material or the like. Use of the filamentary cathode likewise prevents the feature of the present invention that the getter is formed into a thin configuration from being deteriorated, to thereby significantly reduce a thickness of the envelope as compared with the prior art.

As can be seen from the foregoing, the getter of the present invention includes the getter film formed by thermally evaporating the getter layer provided in the envelope, to thereby be easily arranged in a narrow inner space of the envelope. Also, the present invention permits the getter film to be arranged at a position in the envelope at which gas is apt to be produced, resulting in the gettering function being effectively attained. Further, when the getter layer is supported at a part of the lower surface thereof on the support layer, the heating for forming the getter is carried out at increased efficiency, to thereby facilitate the formation.

Further, in the fluorescent display device including the getter, the envelope is substantially decreased in thickness. In particular, when the fluorescent display device includes the field emission cathode acting as the electron source for the display section, the getter chamber member required in the prior art may be eliminated, leading to simplification in manufacturing of the fluorescent display device and the feature of the present invention that the envelope is decreased in thickness can be effectively utilized.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A getter device arranged in an envelope of an electronic element, said envelope having two major surfaces opposed to each other in the thickness direction, to keep an interior of the envelope at a vacuum, comprising:

a getter layer arranged on one of said surfaces; and an electron feed section, comprising a field emission cathode, a gate layer and an insulating layer, arranged on a second of said surfaces and opposed to said getter layer in the thickness direction, for permitting electrons to be impinged in said getter layer to activate said getter layer;

wherein said gate layer lies in between said field emission cathode and said getter layer.

2. A fluorescent display device comprising:

an envelope having two major surfaces opposed to each other in the thickness direction;

a display section arranged in said envelope on one of said surfaces;

a field emission cathode acting as an electron source for said display section on a second of said surfaces; and a getter layer arranged on said one of said surfaces and an electron feed section arranged on said second of said surfaces at the same location in the thickness direction as said field emission cathode, for permitting electrons to be impinged on said getter layer to activate said getter layer;

said electron feed section comprising said field emission cathode, a gate layer, and an insulating layer;

wherein said gate layer lies in between said field emission cathode and said getter layer.

3. A getter device arranged in an envelope of an electronic element, said envelope having two major surfaces opposed to each other in the thickness direction, to keep an interior of the envelope at a vacuum comprising:

a support layer formed on one of said surfaces and provided with openings;

an evaporable getter layer deposited on said support layer; and a getter film formed on said second of said surfaces by evaporation of said getter layer due to heating.

4. A getter as defined in claim 3, wherein said getter device layer is supported on said support layer arranged so as to be contacted with a part of a lower surface of said getter layer.

5. A fluorescent display device comprising:

an envelope having two major surfaces opposed to each other in the thickness direction;

a display device section arranged in said envelope on one of said surfaces;

a field emission cathode acting as an electron source for said display section on a second of said surfaces; and a getter device arranged on said second of said surfaces at the same location in the thickness direction as said field emission cathode in said envelope to keep an interior of said envelope at a vacuum; said getter device comprising:

a support layer formed on said second of said surfaces and provided with openings, said support layer being formed together with an insulating layer of said field emission cathode;

an evaporable getter layer deposited on said support layer; and a getter film formed on said one of said surfaces by evaporation of said getter layer due to heating.

6. A device getter as defined in claim 3, further comprising a gate electrode formed on said getter layer.

7. A getter device arranged in an envelope of an electronic element, said envelope having two major surfaces opposed to each other in the thickness direction, to keep an interior of the envelope at a vacuum, comprising:

a support layer formed on one of said surfaces;

an evaporable getter layer deposited on said support layer;

said getter layer and said support layer each being formed with openings which permit said getter layer to be supported at a part of a lower surface thereof on said support layer; and a getter film formed in said openings of said support layer by evaporation of said getter layer due to heating.

* * * * *